US010968702B2

(12) United States Patent
Mänttäri et al.

(10) Patent No.: US 10,968,702 B2
(45) Date of Patent: Apr. 6, 2021

(54) ROCK DRILLING MACHINE, RIG AND METHOD FOR REINFORCING ROCK SURFACES

(71) Applicant: SANDVIK MINING AND CONSTRUCTION OY, Tampere (FI)

(72) Inventors: Maunu Mänttäri, Tampere (FI); Anssi Kouhia, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 0 days.

(21) Appl. No.: 16/581,961

(22) Filed: Sep. 25, 2019

(65) Prior Publication Data

US 2020/0095862 A1 Mar. 26, 2020

(30) Foreign Application Priority Data

Sep. 26, 2018 (EP) ..... 18196904

(51) Int. Cl.

| | |
|---|---|
| ***E21B 7/02*** | (2006.01) |
| ***E21D 20/00*** | (2006.01) |
| ***E21D 20/02*** | (2006.01) |
| ***E21B 4/18*** | (2006.01) |

(52) U.S. Cl.

CPC ..... *E21B 7/027* (2013.01); *E21B 4/18* (2013.01); *E21B 7/025* (2013.01); *E21D 20/003* (2013.01); *E21D 20/025* (2013.01); *E21D 20/028* (2013.01)

(58) Field of Classification Search

CPC . E21B 4/18; E21B 7/025; E21B 7/027; E21D 20/00; E21D 20/003; E21D 20/02; E21D 20/025; E21D 20/028

See application file for complete search history.

(56) References Cited

U.S. PATENT DOCUMENTS

2011/0070035 A1* 3/2011 Ricardo ..... E21D 21/0053 405/259.5
2014/0140773 A1* 5/2014 Brown ..... E21D 20/028 405/259.5

FOREIGN PATENT DOCUMENTS

| | | | |
|---|---|---|---|
| WO | 00/60215 | A1 | 10/2000 |
| WO | 2004099568 | A1 | 5/2004 |
| WO | 2012171056 | A1 | 6/2012 |

* cited by examiner

*Primary Examiner* — Tara Schimpf
(74) *Attorney, Agent, or Firm* — Corinne R. Gorski

(57) ABSTRACT

A rock drilling machine, rock drilling rig and method of reinforcing rock surfaces by means of grouting material is provided. The grouting material is fed through the rock drilling machine to a drilling tool connected to the rock drilling machine. The rock drilling machine include a flushing feed path, which is utilized in the feeding of the grouting material.

6 Claims, 3 Drawing Sheets

ROCK DRILLING MACHINE, RIG AND METHOD FOR REINFORCING ROCK SURFACES

RELATED APPLICATION DATA

This application claims priority under 35 U.S.C. § 119 to EP Patent Application No. 18196904.9, filed on Sep. 26, 2018, which the entirety thereof is incorporated herein by reference.

TECHNICAL FIELD

The invention relates to an apparatus for injecting grouting material to drill holes when reinforcing rock surfaces with rock bolts. The drill holes are drilled by a rock drilling machine, which is provided with means for feeding the grouting material.

The invention further relates to a rock drilling rig provided with an apparatus for injecting grouting materials and to a method of reinforcing rock surfaces.

BACKGROUND

In mines, construction sites and at other work areas there exists a need to reinforce rock surfaces and to thereby ensure their safety and suitability for the intended purposes. A common method for rock reinforcement is rock bolting. In such reinforcement systems, several rock bolts are fastened in drilled holes by grouting material. In this way rock layers are bonded together so that the risk for collapse is reduced. There are several different systems for inserting the grouting material. However, the present injecting means have shown to contain some disadvantages.

SUMMARY

An object of the invention is to provide a novel and improved rock drilling machine capable to feeding grouting material to drilled holes. The invention further relates to a novel and improved rock drilling rig and to a method of feeding grouting material when reinforcing rock surfaces.

The rock drilling machine according to the invention is characterized by a rock drilling machine that includes a flushing housing and at least one flushing port for feeding flushing fluid to the flushing housing; at least one feed port for grouting material; and at least one flushing feed path being in fluid connection with the feed port and configured to convey the grouting material fed to the feed port (18) via the rock drilling machine to a rock drilling tool connectable to the rock drilling machine, wherein the feed port for the grouting material is located at the flushing housing (14), whereby the grouting material is configured to be fed through the flushing housing to the drilling tool.

The rock drilling rig according to the invention is further characterized by a rock drilling rig including a movable carrier; at least one drilling boom; a drilling unit at a distal end part of the drilling boom, wherein the drilling unit includes a feed beam and a rock drilling machine supported movably on the feed beam; and means for feeding grouting material to a drilling tool connectable to the rock drilling machine in order to inject the grouting material to drill holes drilled by the rock drilling machine, wherein the means for feeding the grouting material is part of the rock drilling machine.

The method according to the invention is characterized by the steps of drilling drill holes in the rock surface by means of a rock drilling machine; injecting grouting material through a drilling tool connected to the rock drilling machine; and arranging a rock bolt to the drill hole; and feeding the injected grouting material through a flushing feed path of the rock drilling machine.

An idea of the disclosed solution is that the rock drilling machine includes integrated means for feeding grouting material to drilled holes. The means has at least one feed port for feeding the grouting material to at least one flushing feed path of the rock drilling machine. The mentioned flushing feed path is configured to convey the grouting material fed to the feed port via the rock drilling machine to a rock drilling tool connectable to the rock drilling machine. In the disclosed solution the grouting material is fed through an inner structure of the rock drilling machine. Thus, the grouting material is in contact with one or more components of the flushing system inside the rock drilling machine.

An advantage of the disclosed solution is that when the grouting material is fed through a basic structure of the rock drilling material the rock drilling machine does not require a separate feed adaptor arranged between a front end and the drilling tool. In other words, the drilling tool may be connected directly to a shank or corresponding integrated element of the rock drilling machine. An advantage of this feature is that when the additional feed adaptor is left out, the drilling equipment may be shorter, and further, impact pulses generated by an impact device of the rock drilling machine are transmitted more effectively to the drilling tool when damping effect of weight of the excessive adaptor does not exist.

A further advantage of the disclosed solution is that the structure may be simple and durable when compared to the known solutions provided with complicated injection adaptors. The disclosed solution may be implemented in different rock drilling machines and may be also be easily retrofitted to the existing devices.

According to an embodiment, the rock drilling machine includes a flushing system for feeding flushing fluid to the drilling tool. The flushing system is connectable to a source of pressurized air or water and when flow of such pressurized fluid is directed to the drilling tool, a drill bit is cooled and drilling cuttings are flushed away from the drilled hole. The aforementioned feed port of the grouting material may be arranged to be in fluid connection with the integrated flushing system. The grouting material is fed through the flushing system to the drilling tool. An advantage of this embodiment is that when the basic flushing system is utilized, no separate fluid channels or hoses are needed and the structure may be simple and durable. A further advantage is that the flushing fluid may be used for flushing the grouting material from inside the rock drilling machine after the grouting is finished.

According to an embodiment, an inner structure of the rock drilling machine is flushed after the grouting material has been fed through the rock drilling machine. The flushing may be done after each drill hole, or alternatively, only after an injecting sequence comprising injection of several drill holes is finished.

According to an embodiment, the basic flushing system of the drilling unit has a dual purpose: to feed flushing fluid to the drilling tool during the drilling operation and to feed grouting material or fluid. Further, since the flushing system is used to flush residuals of the grouting material out of the rock drilling machine, the flushing system may actually have a triple purpose.

According to an embodiment, the rock drilling machine includes a flushing housing and at least one flushing port for feeding flushing fluid to the flushing housing. An inner space inside the flushing housing is in fluid connection with a hollow drilling tool. The feed port for the grouting material is located at the flushing housing. The grouting material is configured to be fed through the flushing housing to the drilling tool. The flushing housing is typically located at a front part of the rock drilling machine. Arranging the aforementioned grouting feed port in the flushing housing is relatively easy since the basic structure of the housing is simple. Further, substituting a conventional flushing housing with the improved flushing housing is easy, whereby the solution may be implemented widely.

According to an embodiment, the flushing housing, or flushing head, is connected to at least one flushing fluid feed conduit and at least one grouting material feed conduit. Further, when the grouting material is resin and the mixing is executed in connection with the flushing housing, then the flushing housing may be connected to three feed conduits, namely to the flushing fluid feed conduit and two resin component feed conduits.

According to an embodiment, a rear end portion of the rock drilling machine, i.e. an opposite end relative to the drilling tool, is provided with the feed port for feeding the grouting material from the rear end portion towards the front end portion and finally to the drilling tool connected to the rock drilling machine. Thus, the grouting material may be arranged to flow inside one or more longitudinal conduits inside the rock drilling machine. The conduit may be arranged to pass centrally a piston of an impact device of the rock drilling machine, for example. The rock drilling machine may be provided with a flushing system utilizing a rear feed principle and including a flushing passage passing through the entire rock drilling machine. The feed system of the grouting material may implement the existing rear feed flushing channels and other means.

According to an embodiment, the grouting material and the flushing fluid are fed through the same feed port to the flushing system or housing. The flushing system or housing has one single feed port which is common for both the grouting material and flushing fluid feeding. In this embodiment the basic flushing system requires no modifications.

According to an embodiment, the mixing device is located at a distance from the drilling tool and the front end of the rock drilling machine towards a rearward end. In other words, the mixing device is located before the front most end of the rock drilling machine. In this way, conventional drilling tools and self-drilling bolt anchors may be used and no separate mixing adaptors or corresponding additional elements are needed between the front end and the drilling tool.

According to an embodiment, the grouting material is pre-mixed before entering to the flushing system. A mixing device may be supported on a side of the rock drilling machine. When the mixing device is located outside an inner structure of the rock drilling machine, then the mixing device may be easily serviced and also changed if needed. A further benefit is that no modifications are required for the basic flushing housing or head because of the grouting material feeding. Thus, the grouting material feed system may be retrofitted to existing rock drilling machines. Further, the disclosed external mounting of the grouting material feed system and the included mixing device offers flexibility to the mounting and positioning of the devices and hoses of the system.

According to an embodiment, a flushing fluid feed line or conduct may be equipped with a grouting feed unit. Thus, the grouting feed unit may be easily mounted to the flushing feed system, whereby the grouting system is easily serviceable and may be retrofitted. The grouting feed unit may have at least a grouting feed valve and may additionally include a mixing device.

According to an embodiment, the rock drilling machine is provided with a mixing device for mixing at least two resin components of a grouting resin together. The mixing device may be integrated inside the drilling machine or it may be an external device mounted on outer surface of the drilling machine.

According to an embodiment, the mixing device is located outside a body of the rock drilling machine and is mounted to a feed conduit, which is in fluid connection with the feed port. In other words, the mixing device is an external unit for executing pre-mixing before the grouting material enters the inner structure of the rock drilling machine.

According to an embodiment, the mixing device is located inside the body of the rock drilling machine and is arranged in connection with the feed port. The mixing device may include a removable cartridge or unit mounted at the feed port. Accordingly, the mixing device may be located inside the body of the drilling machine and may still be easily removed when needed.

According to an embodiment, the mixing device is located inside the flushing housing of the rock drilling machine. An advantage of this solution is that the mixing device is protected by the structure of the flushing housing. A further advantage is that when the mixing device or elements are located inside the flushing housing, the flushing water flushes it automatically and effectively when the normal flushing operation is initiated.

According to an embodiment, the mixing device includes screw surfaces, spirals, a maze or corresponding form surfaces for causing the fed two separate resin component fluid flows to be mixed and to form one homogenous resin mass. The structure of the mixing device may be designed so that the aforementioned mixing elements are easy and quick to substitute and clean when needed. The mixing device may have cartridge type mixing elements for facilitating servicing.

According to an embodiment, the grouting resin is formed of two components and includes components A and B. Resin component A is a base component and resin component B is a hardener. Sometimes the component A is also called as base resin and the component B a catalyst. An advantage of using the grouting resin is that the curing may be quick allowing thereby tightening of the inserted rock bolt to be executed with minimum waiting time. This way efficiency of the reinforcing process may be improved.

According to an embodiment, the grouting material fed via the rock drilling machine to the drilled hole is concrete or other cement based grouting material. The grouting cement may be pre-mixed with water prior being fed to the feed port, or alternatively, two components of the grouting concrete may be fed separately to the feed port and thereafter mixed with a mixing device arranged in connection with the rock drilling machine. The pre-mixing device may be located outside the rock drilling machine and may be connected to grouting feed lines, for example. When the grouting material is fed as two components to the feed port, then the mixing device may be located at the feed port or inside the flushing housing. In all cases, the mixing occurs prior the grouting material leaves the rock drilling machine.

According to an embodiment, the drilling tool connectable to the rock drilling machine is a self-drilling anchor bolt having a hollow shaft for feeding the flushing fluid and the injected grouting material through it, and a drill bit at a distal end of the bolt. The drilling tool is left inside the drill hole after the drilling is finished. In this embodiment the rock bolt serves as a drilling tool, grouting material injector and tensioned rock reinforcing element. An advantage is that the entire process can be executed by means of the rock drilling machine without any indexing movements away from the drill hole. Therefore, the process may be quick and effective.

According to an embodiment, the drilling tool is a conventional type drilling tool including one or more drilling rods and a separate drill bit. The drilling tool can be configured to be reversed after the drilling phase and simultaneously during the reversing phase the grouting material is injected through the drilling tool inside the drilled hole. A reinforcing rock bolt is inserted to the drill hole after the injection phase. The mounting of the reinforcing bolt is executed by means of separate bolt feeding device indexed at the drilled hole.

According to an embodiment, the solution relates to a rock drilling rig provided with a rock drilling machine disclosed herein. The rock drilling rig includes a movable carrier and one or more drilling booms connected to the carrier. Each of the drilling booms are provided with drilling units at their distal end parts. The drilling units include feed beams for supporting the rock drilling machines movably thereon. The rock drilling machine includes means for feeding grouting material to a drilling tool connectable to the rock drilling machine. Thereby grouting material may be injected through the rock drilling machine and the drilling tool to the drill hole being drilled. The grouting material is fed through an inner structure of the drilling machine and no separate feeding adaptors or corresponding separate feed components are needed.

According to an embodiment, the solution relates to a method of reinforcing rock surfaces. In the method, drill holes are at first drilled to the rock surface by means of a rock drilling machine. Thereafter, grouting material is injected through the rock drilling machine and a drilling tool to the drilled hole. The drill hole with the inserted grouting material is provided with a rock bolt, which will rigidly fasten to the rock after the grouting material is cured.

According to an embodiment, the solution relates to a method which uses resin as the grouting material. The resin components of the resin grouting material are mixed by means of a mixing device, which is arranged in connection with the rock drilling machine. In other words, the components are conveyed to the rock drilling machine by means of component feed channels or tubes and are mixed together only at the rock drilling machine. The aforementioned mixing device may be flushed by means of flushing fluid after the grouting resin is injected or a grouting cycle is finished. The flushing can be made by using water or one of the resin components, i.e., either the base component or the hardening component.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
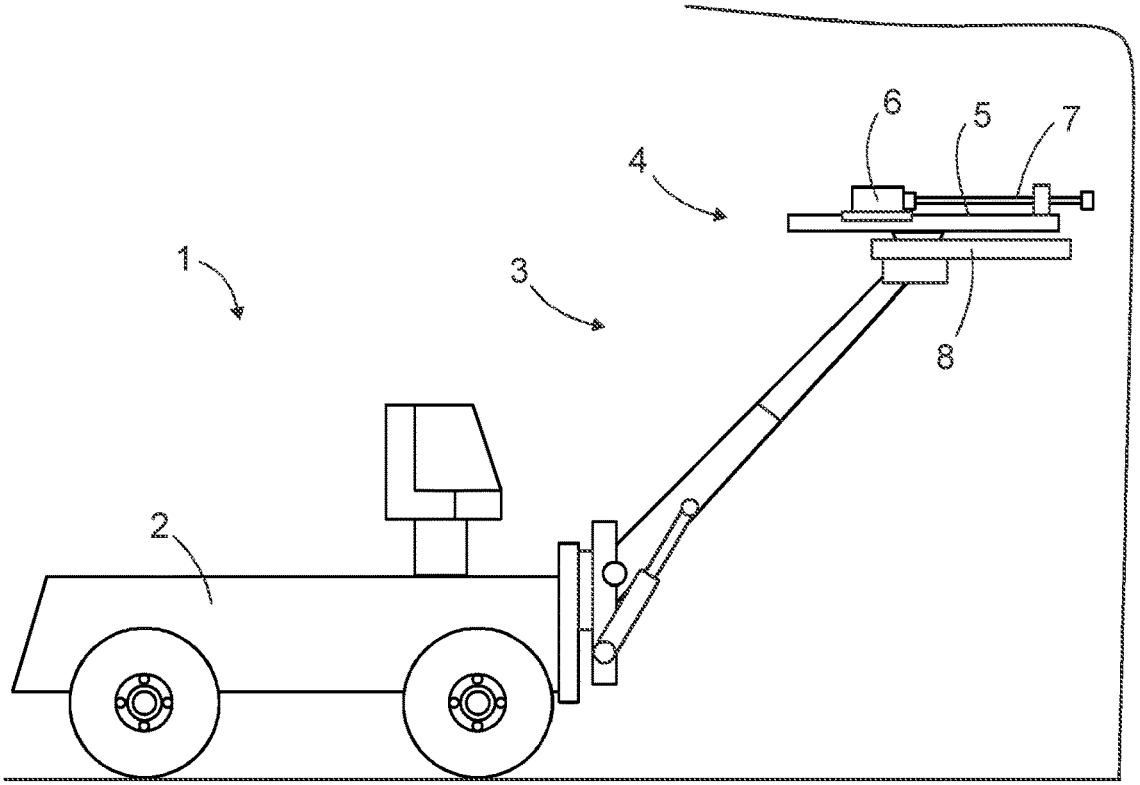
FIG. 1 is a schematic side view of a rock drilling rig intended for underground drilling.

FIG. 1 shows a rock drilling rig 1. The rock drilling rig 1 includes a movable carrier 2 and at least one boom 3 connected to the carrier 2. At a distal end portion of the boom 3 is a drilling unit 4. The drilling unit 4 may include a feed beam 5 and a rock drilling machine 6 supported on it. A drilling tool 7 is connectable to the rock drilling machine 6. The rock drilling machine 6 includes at least a rotating device for rotating the drilling tool 7 around its longitudinal axis.

When the rock drilling machine 6 implements a percussive drilling principle, then it includes an impact device for generating impact pulses which are transmitted to the drilling tool 7.

The rock drilling machine 6 and the boom 3 may be turned so that drill holes can be drilled into walls and ceilings of tunnels and other underground spaces in order to mount reinforcing rock bolts. The drilling unit 4 may have a separate bolt feeder device 8 for mounting the bolts into the drilled holes, or alternatively, self-drilling bolts may be used and thus, no separate feeder 8 is then needed.

The rock drilling machine 6 includes means for feeding grouting material to the drilled holes. For clarity reasons devices for feeding the grouting material are not shown in FIGS. 2-4.

Figure 2:
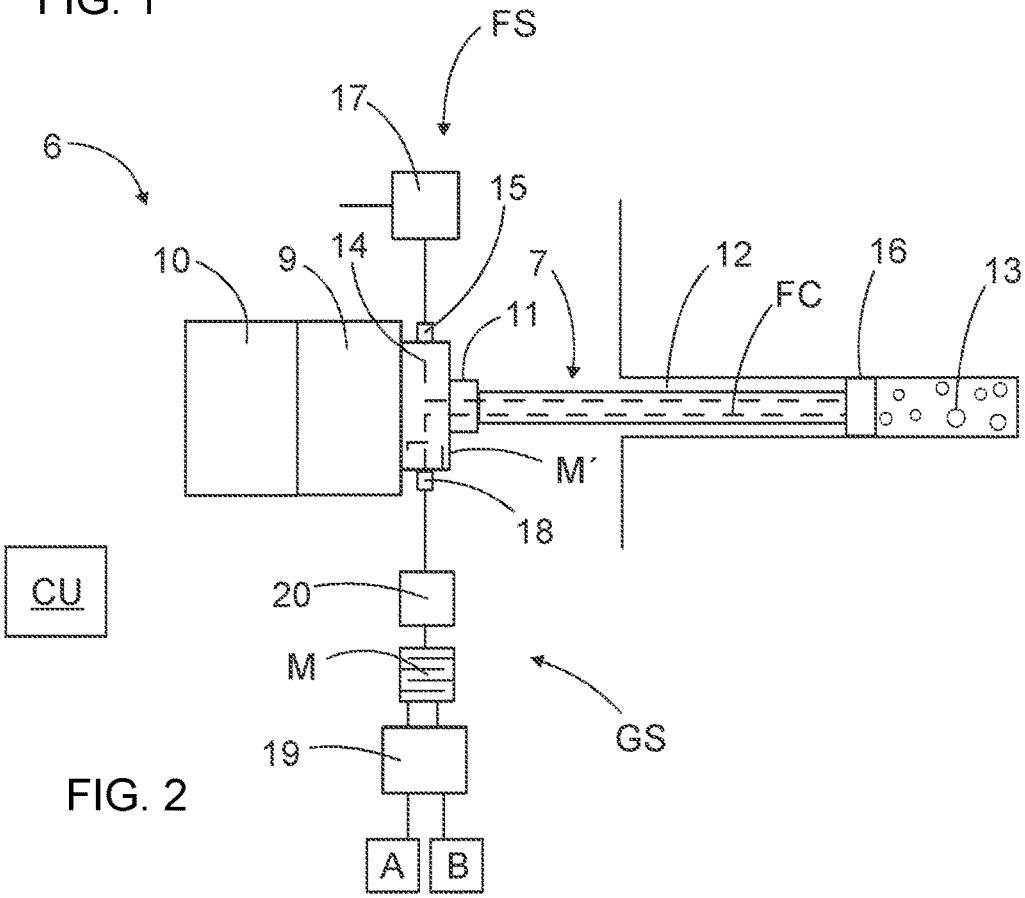
FIG. 2 is a schematic top view of a rock drilling machine provided with a system for feeding grouting material to a drilled hole via an inner structure of the rock drilling machine and a drilling tool.

FIG. 2 discloses a rock drilling machine 6 including a rotation device 9 and an impact device 10. A drilling tool 7 is connected to a shank 11 or corresponding mounting element. The drilling tool 7 produces a drill hole 12 inside, which grouting material 13 is injected through the drilling tool 12 after the drilling is completed. At a front end portion of the drilling machine 6 is a flushing housing 14, which is part of a basic flushing system FS of the drilling machine 6. Flushing fluid, such as water or pressurized air, may be conveyed through a flushing feed port 15 inside the flushing housing 14. A rear end of the drilling tool 7 is in fluid connection with the inner space of the flushing housing 14 whereby the fed flushing fluid may enter a central flushing channel FC of the drilling tool and may be discharged through flushing openings at a drill bit 16. The flushing system FS may further have a flushing valve 17 or corresponding element for controlling the feeding of the flushing agent.

FIG. 2 further discloses that the flushing housing 14 includes a dedicated feed port 18 for feeding grouting material through the flushing housing 14 and flushing channels FC to the drilled hole 12. A grouting material feed system GS includes also a pressurization source 19, such as a pump, which is configured to convey grouting material composites A and B to a mixing device M. The mixing device M mixes the components together by means of suitable mixing elements, such as spirals or a maze, so that the components may react properly and then initiate hardening process.

Thereafter the pre-mixed mass is conveyed to a feed valve 20, which controls feed flow of the grouting material to the flushing housing 14. The mixing device M, feed valve 20, feed channels and the flushing housing 14 may be flushed by feeding one of the components A or B through the grouting material feed system GS in order to remove the mixed mass. The feed valve 20 may alternatively be located before the mixing device M. Further, the mixing device M may alternatively be located at the feed port 18, as it is indicated by a reference M'.

Operation of the rock drilling machine 6 and its flushing system FS and grouting material feed system GS may be controlled by means of one or more control units CU equipped with one or more processors and computer programs including control instructions and strategies for controlling the included devices.

Figure 3:
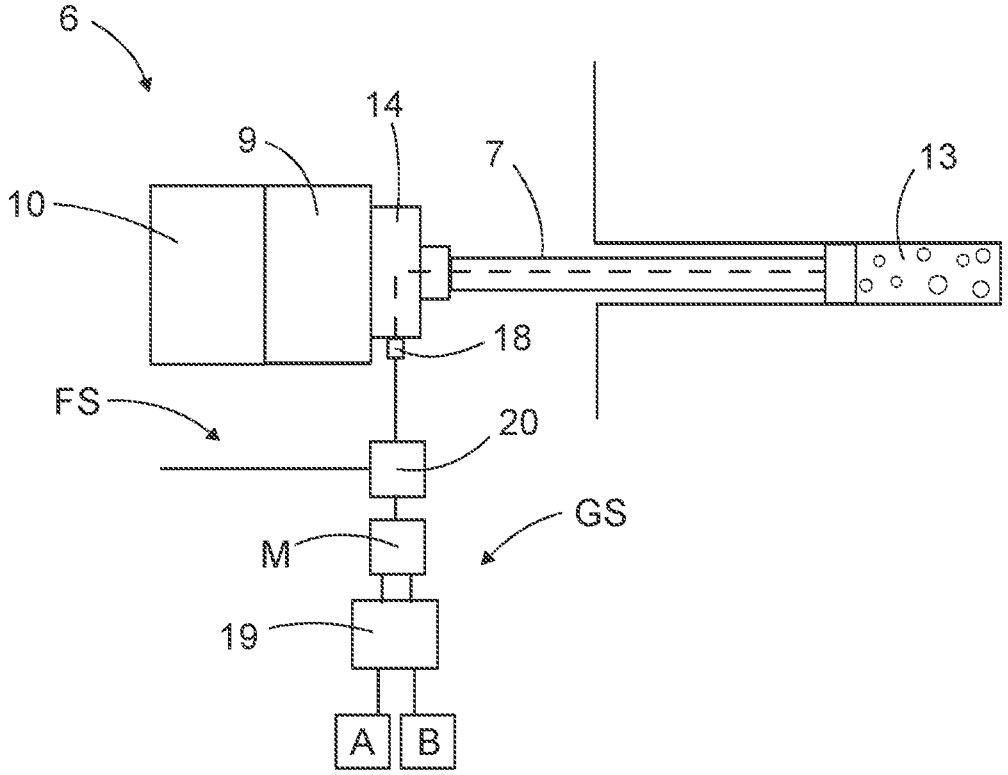
FIG. 3 is a schematic top view of an alternative grouting material feed arrangement.

FIG. 3 discloses a rock drilling machine 6 which differs from the solution of FIG. 2 in that the flushing system FS and the grouting material feed system GS utilize one common feed port 18 for feeding either flushing agent or grouting material through the flushing housing 14 to the drilling tool 7. Further, the feed valve 20 is configured to control feeding of the flushing agent and the grouting material to a flushing path.

Figure 4:
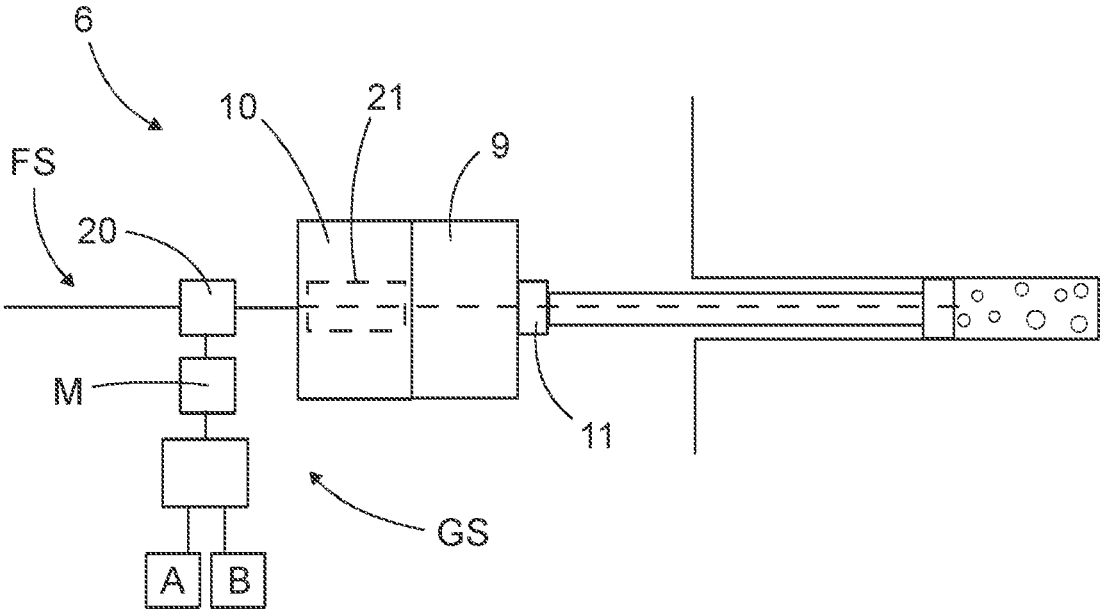
FIG. 4 is a schematic top view of a rock drilling machine provided with a rear feed system intended for feeding flushing agent and grouting material axially through the entire rock drilling machine.

FIG. 4 discloses a rock drilling machine 6 utilizing a rear feeding principle, wherein the flushing agent and grouting material are conveyed through a central axial passage through an impact device 10 and a rotating device 8. In this embodiment, no flushing housing is needed at the front end of the drilling machine 6. The impact device may have a piston 21, which is provided with a central opening in order to lead the flushing agent or the grouting material through it towards a shank 11, which also has a central opening together with the rotating device 9.

The pressurization device 19 and storages of components A and B may be located on the carrier of the rock drilling rig and the components may be conveyed through hoses to the rock drilling machine. The same principle applies to the flushing system.

Figure 5:
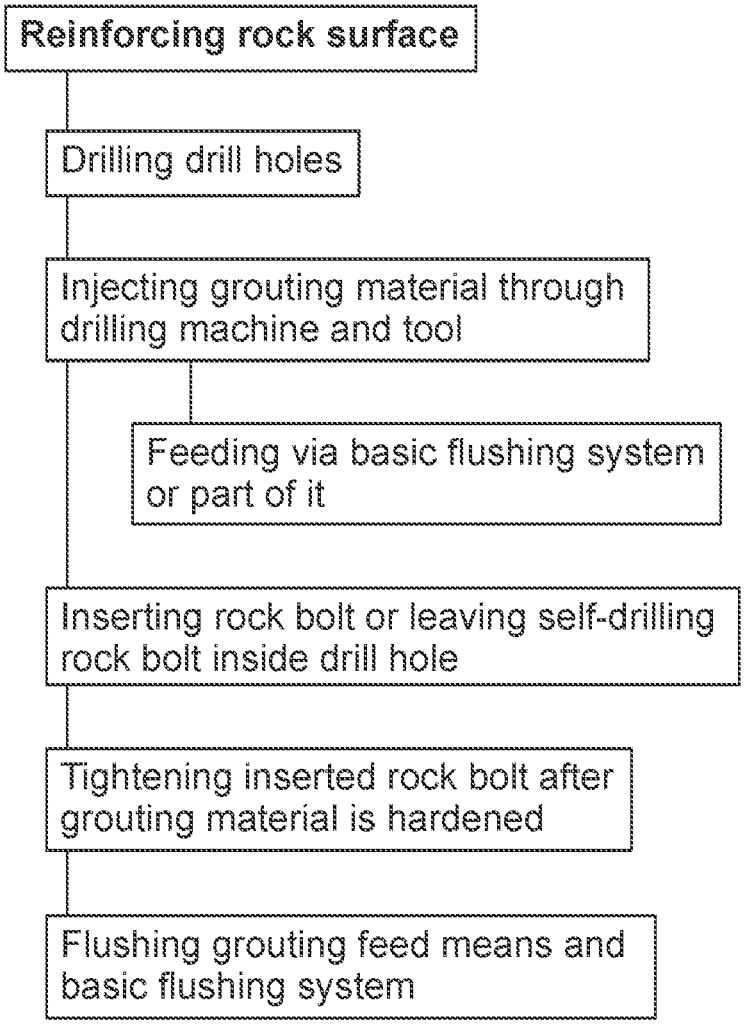
FIG. 5 is a diagram showing some principles and features relating to the rock reinforcing.

FIG. 5 discloses features and steps relating to the disclosed reinforcing method as described above.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A rock drilling machine comprising:

a flushing housing and at least one flushing port arranged for feeding flushing fluid to the flushing housing;

at least one feed port arranged for receiving grouting material;

at least one flushing feed path in fluid connection with the at least one feed port and configured to convey the grouting material fed to at least one the feed port via the rock drilling machine to a rock drilling tool connectable to the rock drilling machine, wherein the at least one feed port for the grouting material is located at the flushing housing, whereby the grouting material is configured to be fed through the flushing housing to the drilling tool; and an external mixing device arranged for mixing at least two resin components of the grouting material together before the grouting material enters the flushing housing, the mixing device being located outside a body of the rock drilling machine and mounted to a feed conduit in fluid connection with the at least one feed port, wherein the grouting material and the flushing fluid are configured to be fed through a single feed port, which is common for both the grouting material and flushing fluid feeding.

2. The rock drilling machine as claimed in claim 1, further comprising an integrated flushing system arranged for feeding the flushing fluid to the drilling tool, wherein the at least one feed port is in fluid connection with the flushing system for feeding the grouting material through the flushing system to the drilling tool.

3. The rock drilling machine as claimed in claim 1, wherein the drilling tool connectable to the rock drilling machine is a self-drilling anchor bolt including a hollow shaft for feeding the flushing fluid and the injected grouting material therethrough and a drill bit located at a distal end of the bolt.

4. A rock drilling rig comprising:

a movable carrier;

at least one drilling boom;

a drilling unit at a distal end part of the drilling boom, wherein the drilling unit includes a feed beam and a rock drilling machine according to claim 1 supported movably on the feed beam; and the rock drilling machine including a grouting material feed system arranged for feeding grouting material to a drilling tool connectable to the rock drilling machine wherein the grouting material feed system is arranged to inject the grouting material to drill holes drilled by the rock drilling machine.

5. A method of reinforcing rock surfaces, the method comprising:

drilling drill holes in a rock surface with a rock drilling machine;

mixing resin components of a grouting material with an external mixing device located outside a body of the rock drilling machine and connected to a feed conduit in fluid connection with a feed port arranged for receiving the grouting material;

injecting the grouting material through a drilling tool connected to the rock drilling machine;

arranging a rock bolt to the drill hole; and feeding the grouting material through a flushing housing, the flushing housing, feed conduit and feed port being part of a flushing feed path of a flushing system of the rock drilling machine, and at least one flushing port being arranged for feeding flushing fluid to the flushing housing, wherein the injected grouting material and the flushing fluid is fed through the flushing feed path of the rock drilling machine, and wherein the grouting material and the flushing fluid are configured to be fed through a single feed port, which is common for both the grouting material and flushing fluid feeding.

6. The method as claimed in claim 5, further comprising flushing the flushing feed path after the grouting material is fed by feeding the flushing fluid therethrough.

* * * * *